United States Patent [19]

Furbee et al.

[11] Patent Number: 5,007,074

[45] Date of Patent: Apr. 9, 1991

[54] X-RAY TUBE ANODE FOCUSING BY LOW VOLTAGE BIAS

[75] Inventors: Avery D. Furbee, Elmhurst; Carl F. Bauer, Chicago; John S. Ramos, Buffalo Grove, all of Ill.

[73] Assignee: Picker International, Inc., Cleveland, Ohio

[21] Appl. No.: 385,004

[22] Filed: Jul. 25, 1989

[51] Int. Cl.[5] ..... H01J 35/14

[52] U.S. Cl. ..... 378/138; 378/101; 378/136

[58] Field of Search ..... 378/119, 121, 136, 137, 378/138, 101, 102

[56] References Cited

U.S. PATENT DOCUMENTS

| | | | |
|---|---|---|---|
| 1,923,876 | 8/1933 | Mutscheller . | |
| 2,340,363 | 2/1944 | Atlee, et al. . | |
| 2,921,214 | 1/1960 | Broad . | |
| 3,103,591 | 9/1963 | Rogers, et al. . | |
| 3,192,425 | 6/1965 | Foster . | |
| 3,646,379 | 2/1972 | Garewal, et al. . | |
| 3,743,836 | 7/1973 | Holland et al. . | |
| 3,783,333 | 1/1974 | Atlee, et al. . | |
| 3,962,583 | 6/1976 | Holland, et al. . | |
| 4,213,048 | 7/1980 | Quang . | |
| 4,344,011 | 8/1982 | Hayashi et al. | 378/138 |
| 4,373,144 | 2/1983 | Franke . | |
| 4,685,118 | 8/1987 | Furbee, et al. . | |
| 4,689,809 | 8/1987 | Sohval | 378/138 |
| 4,764,947 | 8/1988 | Lesensky . | |
| 4,799,248 | 1/1989 | Furbee et al. . | |

FOREIGN PATENT DOCUMENTS

| | | | |
|---|---|---|---|
| 0198536 | 9/1986 | Japan | 378/138 |

*Primary Examiner*—Carolyn E. Fields
*Assistant Examiner*—David P. Porta
*Attorney, Agent, or Firm*—Watts, Hoffmann, Fisher & Heinke

[57] ABSTRACT

An x-ray tube is disclosed whose cathode cup is battery biased at a low level, approximately 30 volts DC, to inhibit "wings" on the focal spot of electrons bombarding the anode. The battery for providing bias, floats at the DC electrical potential applied to the cathode, many KV below ground potential. Geometric modifications to the filament/focusing cup arrangement are also included. The geometrical characteristics partially inhibit the dispersion of electrons, inhibiting the formation of "wings" on the x-ray focal spot, particularly at high current levels. At lower current levels, the low DC battery bias enhances the anti-dispersion effects of the geometrical characteristics to inhibit wing formation even at these lower current levels.

19 Claims, 2 Drawing Sheets

X-RAY TUBE ANODE FOCUSING BY LOW VOLTAGE BIAS

BACKGROUND OF THE INVENTION

A. Technical Field

The present invention relates generally to x-ray tube technology. More specifically, the present invention relates to geometrical and electrical biasing improvements for reducing the size of the focal spot of electrons striking the tube anode.

B. Background Art

Conventional diagnostic use of x-radiation includes the form of radiography, in which a still shadow image of the patient is produced on x-ray film, and fluoroscopy, in which a visible real time shadow light image is produced by low intensity x-rays impinging on a fluorescent screen after passing through the patient.

In a typical x-ray tube, electrons are generated of a filament coil heated to thermionic emission. The electrons are accelerated as a beam from a tube cathode through an evacuated chamber defined by an envelope, toward a tube anode. When the electrons strike the anode with large kinetic energies, and experience a sudden deceleration, and x-radiation is produced. The x-ray tube assembly is contained in a housing which includes a window transmissive to x-rays, such that radiation from the anode passes through the window toward a subject undergoing examination or treatment.

Most x-ray tube designs employ filaments as a source of electrons with which to bombard the tube anode. A filament is a coil of wire which is electrically energized so that electrons are thermionically emitted from the filament and accelerated toward the anode due to a very large DC electrical potential difference between the cathode and the anode. Often this electrical potential difference is of the order of 150,000 volts, ($\pm$75,000 volts to ground) necessitating elaborate means for isolating the electrical elements and connectors which are used to apply such an amount of voltage.

The cathode filament is thermionically energized with a relatively low voltage (on the order of 10 volts) and high current AC signal. Although the peak-to-peak magnitude of the energization signal for the filament is low, the reference, or average, potential of the filament is, in the instance described here, about $-75{,}000$ volts DC. Stated another way, the voltage on the filament with respect to ground is up to $-75{,}000$ volts, plus or minus a low level alternating current signal needed to boil off electrons from the filament. At these high voltages, the filament input must be heavily insulated to prevent arcing. The insulation typically is in the form of high voltage cabling and connectors, which are expensive and complex in design. In fact, any electrically conductive element or member electrically contacting or coupled to the cathode must be provided with this type of expensive isolative means.

It is desirable to focus the electrons so that the focal spot at which they strike the anode is as small as possible. This causes the resulting x-rays to emanate from as small a source as possible, to minimize diffusion in the x-ray generated image.

A trend toward shorter x-ray exposure times in radiography has dictated a need for greater intensity of radiation and hence higher electron currents. Attempts to increase the intensity, while, at the same time, decreasing the focal spot size, can cause overheating of the x-ray tube anode.

One way to control the size of the focal spot of the electrons on the anode is to mount the cathode filament on a cathode focusing or support cup member. It has been proposed to apply an electrical bias voltage between the cathode cup member and the filament in order to control, to some extent, the size of the focal spot.

Cathode cup and filament arrangements for controlling the size and shape of the electron focal spot on the tube anode are discussed in U.S. Pat. Nos. 4,685,118, issued on Aug. 4, 1987, and 4,799,248, issued Jan. 17, 1989, both to Furbee, et al., and assigned to the assignee of the present invention. These two U.S. Patents. are hereby expressly incorporated by reference in their entirety.

It is known in the art to apply a DC bias between the filament and the cup of an x-ray tube in order to reduce unwanted "wings", or diffused areas, appearing as part of the x-ray focal spot. The focused electron beam, at the focal spot, has a generally rectangular shaped distribution, the length of which corresponds to the filament length and the width of which comprises a central portion produced from electron emission from the front of the filament, and peripheral portions or "wings" produced from electron emission from the back or side portion of the filaments. One proposal for eliminating wings is discussed in U.S. Pat. 4,764,947, issued on Aug. 16, 1988, to Lesensky and entitled "Cathode Focusing Arrangement".

In order to electrically bias the filament/cup arrangement to sufficiently eliminate the "wings" as proposed by Lesensky, however, the DC voltage has had to be on the order of a hundred volts or more. Voltages of this magnitude require the provision of rather complex DC power sources, either independent sources, or means for deriving the DC voltage from the x-ray filament AC power supply. A complicating factor is that these power supplies must be isolated to the kV level at which the cathode and filament respectively reside during x-ray tube operation.

Proposals have also been made for governing the mechanical geometrical relationships of the various parts of an x-ray tube, particularly the filament and focusing cup, to eliminate the "wings" on the x-ray focal spot, without the need for any DC filament/cup biasing at all. See the above identified '947 patent, column 8, line 34 et. seq. When one so modifies an x-ray tube's geometry to eliminate wings, however, emission levels from the filament have been seriously reduced. This means that, for a given desired radiation emission level, the filament must be operated at a higher temperature than would otherwise be the case. The higher temperatures necessitated by the same mechanical design which helps eliminate the wings also, unfortunately, shortens filament life, and therefore x-ray tube life, often to an unacceptable degree.

It is a general object of this invention to increase the emission of the filament, at a given filament operating temperature, without increasing the width of the focal spot, specifically by eliminating the undesirable dispersion of the x-ray tube electron beam, which causes the "wings", by the use of simple and inexpensive means.

DESCRIPTION OF THE INVENTION

The present invention reduces or eliminates the disadvantages of the prior art by the use of both low voltage electrical biasing and by mechanical geometrical modification in an x-ray tube to minimize the dispersion of the electrons from the beam into the undesirable "wings" pattern in the focal spot. The geometry of the focusing cup and its relation to the filament is modified in a way which, while imperfect in that it only partially eliminates the wings, does not substantially reduce the emission intensity, as would be the case if the geometrical modifications were so severe that wings were substantially fully eliminated through geometry alone. The x-ray tube of the present invention supplements this partially curative geometry with the application of a small, as opposed to a high voltage, electrical DC bias between the cathode filament and focusing cup. Due to the partial beneficial effect of the mechanical modifications, the bias need not be, as previously required, on the order of several hundred volts, a magnitude necessitating complex and expensive DC power sources and isolative equipment. Rather, only a rather low bias, on the order of 30 volts, is required to substantially eliminate the portion of the wings which would remain if only the geometrical modifications were employed.

Since only about 30 volts of bias is required, the bias is obtainable by the use of a small, self-contained battery which can "float" at the very high kV potential of the filament, and it need not be provided with the isolative protection a more complex power source, connected to external elements, would require.

The use of a combination of both geometrical modification and electrical bias means for improving the size and precision of the focal spot substantially lessens the voltage magnitude requirement for the bias portion of the correction scheme. This reduction in voltage requirement enables provision of that voltage by means of a simple battery. The use a battery enables the bias voltage source to be located between the x-ray tube envelope and the housing, a region whose ambient potential is that of the cathode. Placement of the battery in this region thus enables the battery to "float" with the potential of the cathode and of the cup. This floating of the battery obviates the need for any external connections to provide the bias voltage, and the need for providing expensive and complex isolative means for the bias voltage source or its connecting leads or other members.

These attributes of the inventive system result in reduction in expense of the system manufacture, due to the elimination of the need to provide a complex external high voltage bias source which must be isolated against extreme electrical potential. It also contributes significantly to the simplicity and reliability of the system. Use of the bias voltage, in combination with the geometrical modifications to the cathode cup, enables the use of geometrical modifications which are not so severe as to significantly reduce the emission capability of the tube for a given filament current. This non-interference with emissive capability lengthens filament life, and consequently tube life, reducing the frequency of tube breakdown and necessary replacement. Moreover, since there is essentially no current flow between the filament and cathode cup, the battery will last the lifetime of the x-ray tube.

In accordance with one embodiment, the invention comprises an x-ray tube including an anode, a cathode and a cathode focusing cup, wherein a bias voltage is applied between the cathode filament and the cathode focusing cup by means of a battery.

According to another aspect of the invention, there is defined an x-ray tube having a cathode filament, an anode, and a cathode focusing cup, wherein a relatively low DC bias is applied between the cup and the filament, on the order of about 30 volts. In accordance with a more specific embodiment, the cathode cup defines a cathode slot in which the filament is located aligned with the slot, but at a relatively high, or exposed, location with respect to the slot.

In accordance with another specific aspect, the cathode cup defines two cavities or slots, in a stepped relation, and the larger of the two slots in the cathode cup is made relatively narrower relative to the prior art design.

The bias, being small, has very little effect on the focal spot when the tube is operated at high current, and does not substantially affect the level of emission of the filament when operated at high current.

This invention will be better understood by reference to the following detailed description, and to the drawings, in which:

BEST MODE FOR CARRYING OUT THE INVENTION

Figure 1:
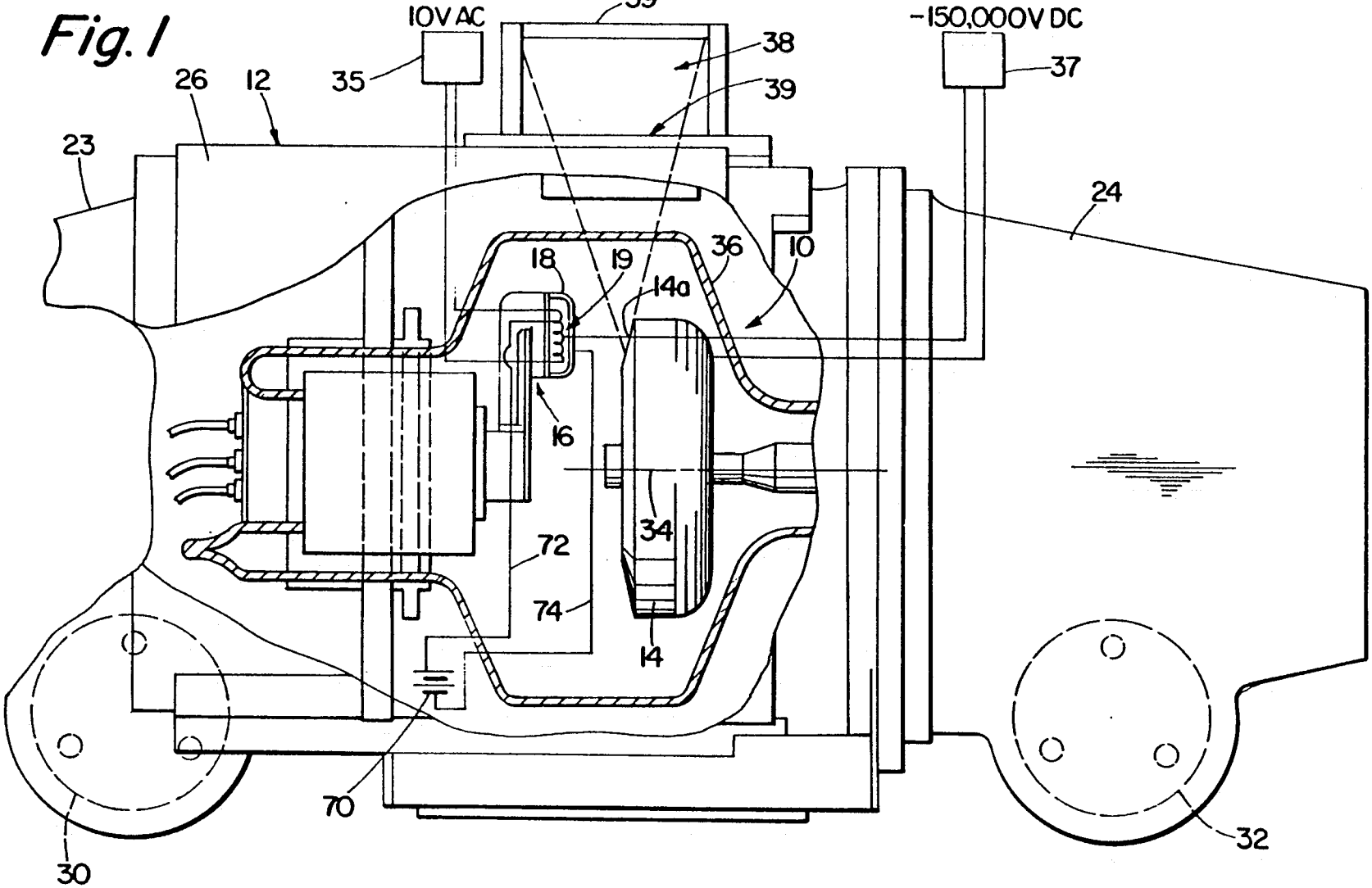
FIG. 1 is an elevational view, partly broken away, illustrating the major components of an x-ray tube in which the present invention is incorporated.

Turning to the drawings, FIG. 1 discloses an x-ray tube 10 mounted within an x-ray tube housing 12. The x-ray tube 10 includes an anode 14 having an anode surface 14*a* facing an x-ray tube cathode 16 including a cathode focusing cup 18. As is well known in the prior art, a cathode filament 19 mounted to the cathode cup 18 is energized to emit electrons which are accelerated to the anode 14 to produce x-radiation for diagnostic imaging, therapy treatment and the like. The cathode cup 18 acts as a grid to focus electrons to a focal spot on the anode 14.

The housing 12 comprises two end portions 23, 24 and an intermediate or middle portion 26. The intermediate portion is coupled to the end portions by fluid tight seals to allow the x-ray tube housing 12 to be filled with a heat insulating fluid, typically oil. The end portions 23, 24 define high voltage connector sockets 30, 32 which transmit high voltage inputs to the x-ray tube 10 through pin contacts.

The x-ray tube anode 14 is mounted for rotation about an axis 34. Both the rotating anode 14 and a fixed cathode 16 are mounted within an evacuated glass envelope 36. Electrons emitted by the cathode filament 19 accelerate toward a target or focal spot on the anode and cause x-rays 38 to be emitted. The anode 14 is rotated in a known manner to distribute the heating about the anode circumference. The intermediate portion 26 of the x-ray tube housing 12 includes an x-ray transmissive window 39 of a suitable material such as aluminum.

The window is aligned with the anode focal spot from which the x-rays 38 are emitted so that the x-rays pass through the window to the exterior of the housing.

An AC source, generally depicted as block 35, is coupled to the filament 19 to provide about a 10 volt AC heating current to the filament. The AC source, and its manner of coupling to the filament are known. A source of high voltage DC electrical potential, generally shown at 37, of known type, is coupled in known fashion between the anode and the cathode to provide the high voltage DC accelerating potential for the electrons emitted from the cathode toward the anode.

As will be described in more detail below, a battery 70 is coupled between the cathode focusing cup and the filament, to provide a small DC bias between these two elements. This coupling is effected by means of conductive leads 72, 74.

Further details regarding the construction and arrangement of an x-ray tube and its housing may be obtained by referring to either of U.S. Pat. Nos. 3,859,534 to Laughlin, or 4,097,759 to Furbee et al., both of which are assigned to the assignee of the present invention. Those patents and their disclosures are specifically and expressly herein incorporated by reference.

Figure 2:
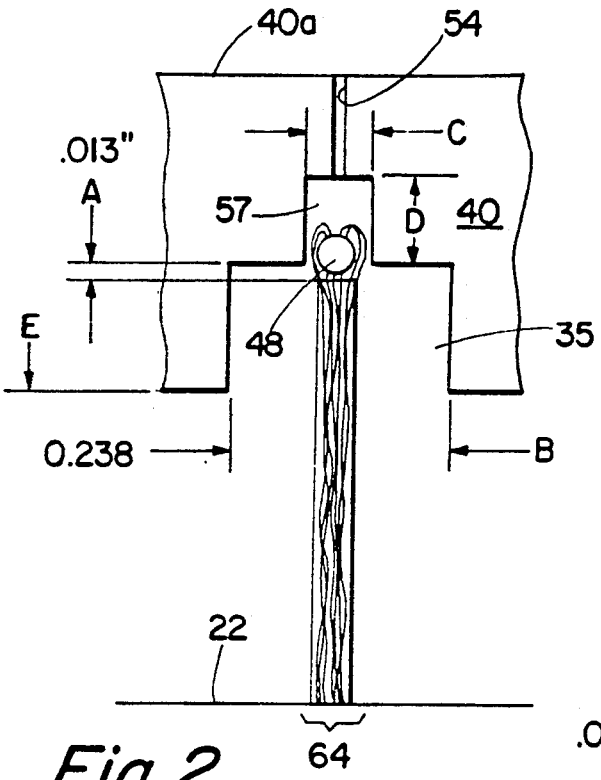
Fig. 2 PRIOR ART
FIG. 2 is a cross-sectional view of a prior art embodiment of a detail of the tube FIG. 1.

A prior art cathode cup 40 is illustrated in FIG. 2. This cup 40 is made of metal and defines two cavities 55, 57. First, or upper, cavity 55 is relatively large and is defined generally by the body of the cup 40. Second, or lower cavity 57 is smaller, and is recessed into the bottom of the first cavity 55, in the form of a slot. A filament 48 is recessed, or "set" partially into the second cavity 57. Only about 25% of the diameter of the filament protrudes from the slot 57.

Figure 3:
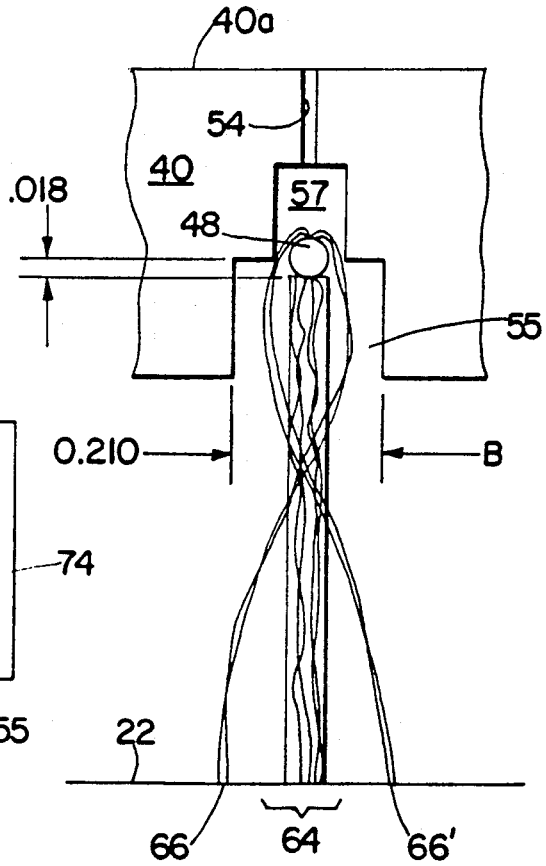
FIG. 3 is a cross-sectional view illustrating a detail of the tube of FIG. 1 embodying a mechanical or geometrical aspect of the present invention.
Figure 4:
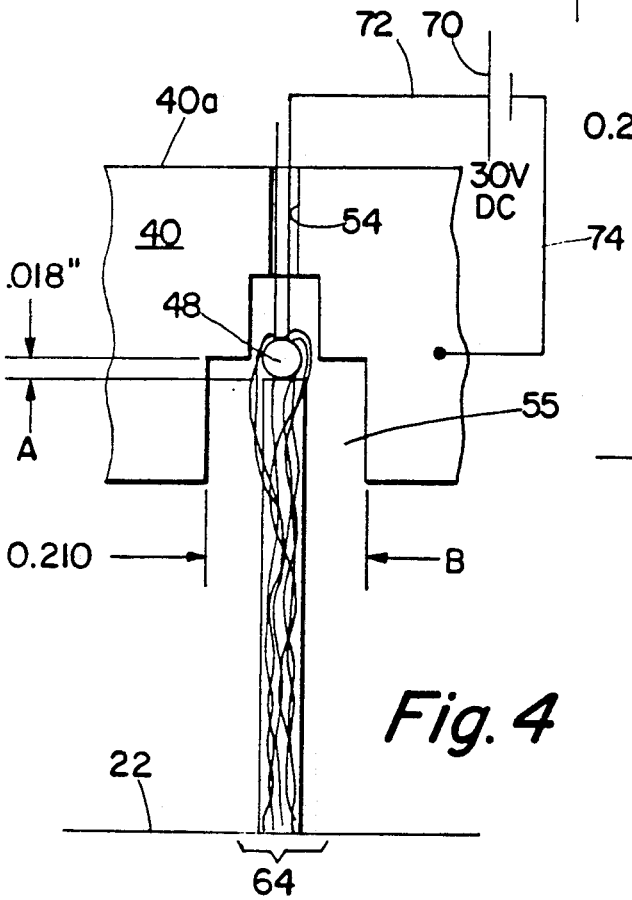
FIG. 4 is a cross-sectional view of a detail of the tube of FIG. 1 embodying both a mechanical and an electrical aspect of the present invention.

In the embodiments of FIGS. 2–4, the filament is a cylindrical coil of 0.008 inch wire, the coil being 0.050 inches in diameter. Also, the cavity or slot 57 is 0.074 inches deep, (arrows D) and 0.090 inches wide (arrows C).

An energization input to the filament 48 is routed from the rear surface 40*a* of the cathode cup 40 through an aperture 54 extending from that surface to the filament 48.

Means including isolation transformers and an external voltage source (not shown) is provided for applying, between the cathode and the anode, a DC voltage of approximately 150,000 volts, the cathode being maintained, during operation at approximately −75,000 volts with respect to ground. Additionally, an AC voltage source (also not shown) is provided for impressing upon the filament an AC signal having a peak-to-peak voltage swing of approximately 10 volts about the −75,000 volt potential of the cathode. The AC current is about 5 amperes.

Further details of filament/cathode construction are discussed in U.S. Pat. No. 4,685,118, to Furbee et al., which has above been expressly incorporated by reference. See particularly FIGS. 6–8, and the descriptive material in the specification of that patent relating to these figures.

U.S. Pat. 4,685,118 describes a particular type of segmented cathode cup having provision for multiple filaments. It is to be understood that the presently described invention is suitable for use in x-ray tubes having such types of complex cathode cups and multiple filaments. For the purposes of simplicity, however, the present invention will be described in connection with a basic, non-segmented cathode cup having only a single filament.

The focusing cup can be of either the round variety, (as taught in the '118 patent incorporated by reference) or it can be of the rectangular variety, such as described in the above identified '947 patent. Accordingly, the Figures in this document, and the associated description, does not attempt to distinguish between round and rectangular cathode focusing cups. For the purposes of this description, the term "width" when applied to a rectangular cup, refers to the narrower of its two cross-sectional dimensions, while the same term, applied to a round cup, is intended to refer to the inside diameter thereof.

The geometry illustrated in FIG. 2 is a geometry which substantially eliminates "wings" without the need for electrical biasing. In the FIG. 2 embodiment, the width of the large cavity 55 is approximately 0.238 inches. To achieve adequate emission using this configuration, the filament must be driven at about a 5.3 ampere current. In tests running at a filament current of about 5.3 amperes and a filament current of about 800 mA., filament life, and consequently tube life, averaged about 12 hours. This is considered inadequate for many applications, particularly because an x-ray tube can be very expensive.

FIG. 3 illustrates the cup/filament geometry, similar to that of FIG. 2, but modified in accordance with one aspect of the present invention.

More specifically, the filament is partially "set", or recessed, higher (more exposed) in the slot more than in the case of FIG. 2. In particular, the filament is set such that between about 35% to 50% of the filament diameter protrudes from the slot.

In the FIG. 3 embodiment, the amount of protrusion, or exposure, of the filament outside the slot (see arrows A) is about 0.018 inches, i.e., about 35% of the filament coil diameter of 0.050 inch.

The geometry of FIG. 3 is also modified in that the distance B has been reduced to approximately 0.210 inches, from about 0.238 inches in FIG. 2. The other dimensions are the same as in FIG. 2.

It can be seen intuitively from FIG. 3 that, because of the increased amount of exposure or protrusion of the filament from the slot 57, more of the electrons emitted from the backside of the filament find their way to the x-ray focal spot 64 on the anode. In the instance of FIG. 3, however, the anode focal spot 64 exhibits wings 66, 66'. The wings are due to the fact that the electrons emitted from the backside of the filament, i.e., the side of the filament facing away from the anode, are not sufficiently controlled by the electric fields established by the geometry of the cup to, alone, focus the electrons down into a sufficiently fine anode focal spot. The reduction in the width (dimension B) of the larger cavity 55 helps somewhat to control these errant electrons, but does not in all instances control the direction of these dispersing electrons with sufficient precision.

Tests have shown that, in use of the embodiment of FIG. 3, the appearance of the "wings" is most pronounced when the tube is operated at low tube current, such as in operating in the fluoro mode. At higher emission levels, the magnitude of the wings is lessened.

In use of the FIG. 3 embodiment, with a filament current of 5.0 amperes, and a tube current of 800 mA, tests have shown that the tube filament life is approximately 27 hours, far greater than that of the FIG. 2 embodiment. The wings which appear are approximately 1.3 millimeters in width. No bias is applied in the FIG. 3 embodiment between the cathode focusing cup and the filament.

FIG. 4 illustrates the FIG. 3 embodiment, further modified to add a gentle, approximately 30 volt, bias between the cathode focusing cup and the filament. This is accomplished by the use of a battery 70, coupled respectively to the filament and to the cup by conductive leads 72, 74. The geometry of the FIG. 4 embodiment is identical to that of the FIG. 3 embodiment, the only difference being the addition of this mild electrical bias.

The battery is located outside the envelope of the tube, but inside the housing. As such, the battery "floats" with the very large negative DC voltage applied to the cathode filament and to the cathode focusing cup.

The battery, since it applies a negative bias with virtually no current flow, can be expected to last for a very long time, perhaps for years. If desired, the battery can be equipped with simple and conventional disconnect means to permit its discarding and replacement if it wears out or becomes defective.

The preferred embodiment, calling for a bias of about 30 volts, is well within the capability of present battery technology in the contemplated environment. Tests have shown that bias voltage of nearly 100 volts are obtainable, with some difficulty, by the use of batteries. It is reasonable to foresee that further improvement in battery technology can raise the limits of readily achievable bias which can be obtained from such batteries.

Figure 1A:
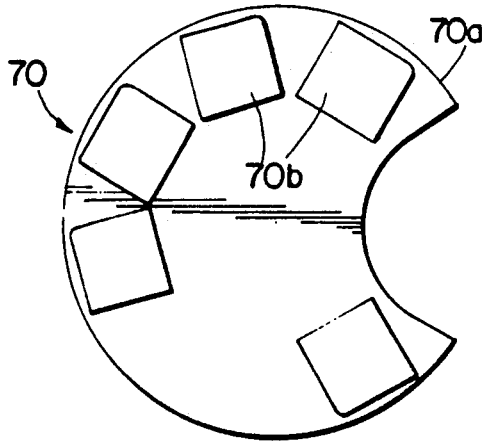
FIG. 1*a* is a plan view of a detail of the x-ray tube assembly shown in FIG. 1.

FIG. 1 illustrates the battery 70 and its connecting leads in generalized schematic form for purposes of clarity. The preferred embodiment of the battery 70, however, is illustrated in FIG. 1*a*. The battery 70 includes five individual batteries connected in series and mounted on a round circuit board 70*a*. The individual series connected batteries are indicated at reference character 70*b*. Each of the batteries indicated at 70*b* is preferably a Ray-0-Vac model FB 1225 H2.

In the preferred embodiment, the actual placement of the battery pack 70*b* is attached to the outer surface of the left hand end of the envelope, with reference to FIG. 1. The battery pack is thus located outside the envelope, but within the tube housing.

The use of a combination of both geometrical modification and electrical bias means for improving the size and precision of the focal spot substantially lessens the voltage magnitude requirement for the bias portion of the correction scheme. This reduction in voltage requirement enables provision of that voltage by means of a simple battery. The use a battery enables the bias voltage source to be located between the x-ray tube envelope and the housing, a region whose ambient potential is that of the cathode. Placement of the battery in this region thus enables the battery to "float" with the potential of the cathode and of the cup. This floating of the battery obviates the need for any external connections to provide the bias voltage, and the need for providing expensive and complex isolative means for the bias voltage source or its connecting leads or other members.

These attributes of the inventive system result in a reduction in expense of system manufacturer, due the elimination of the need to provide a complex external high voltage bias source which must be isolated against extreme electrical potential. It also contributes significantly to the simplicity and reliability of the tube. Use of the bias voltage, in combination with the geometrical modifications to the tube, enables the use of geometrical modifications which are not so severe as to significantly reduce the emission capability of the tube for a given filament current. This non-interference with emissive capability lengthens filament life, and consequently tube life, reducing the frequency of tube breakdown and necessary replacement.

Accordingly, this invention, while enabling elimination of wings from the focal spot by the use of only about 30 volts of bias voltage, while still maintaining good emission intensity, should not be construed as limited to the use of bias voltages of 30 volts or lower.

Tests have shown that this small modification to the FIG. 3 embodiment transforms the FIG. 3 embodiment from one producing a generally unsatisfactory result to one producing a finely focused focal spot having no wings. In tests, using a 5.0 ampere filament current and operating the tube current at 800 mA., an average tube life of 27 hours was obtained, and the focal spot showed substantially no wings at all.

While the geometry of the FIG. 3 and FIG. 4 embodiments is presently considered the preferred geometry, tests have indicated that the present invention is not limited to those precise geometries. It is important, however, that the amount of filament exposure outside the slot 57, together with the width of the larger cavity 55, be carefully chosen with respect to one another.

More specifically, tests have indicated that the filament exposure outside the slot 57 can advantageously range between approximately 35% to 50% of the filament coil diameter. As the amount of filament exposure outside the slot increases, the width of the larger cavity 55 should be decreased. Tests have indicated that, where the filament is exposed to the extent of about 50%, the larger cavity 55 should be narrowed significantly, down to about 0.150 inches. Filament exposures intermediate between 35% and 50% call for large cavity widths intermediate between 0.210 and 0.150 inches, calculated on an approximately proportional basis.

The drawings, particularly FIGS. 2–4, have been prepared to emphasize differences in geometry, rather then being drawn precisely to scale.

It is to be understood that this description of the present invention is intended as illustrative, rather than as exhaustive, of the invention. Those of ordinary skill in the art may make certain additions or modifications to, or deletions from, the embodiments specifically described herein without departing from the spirit or the scope of the invention, as defined in the following claims.

What is claimed is:

1. An x-ray tube including a filament, an anode, a cathode focusing cup proximate the filament, means for applying a DC potential difference between the cathode focusing cup and the anode, means for applying a heating current to the filament, and an envelope enclosing the filament, anode and cup, said x-ray tube further comprising:

a battery having a voltage of nor more than about 30 volts and coupling means for applying a DC bias voltage from said battery between said filament and said focusing cup.

2. The x-ray tube of claim 1, wherein:

(a) said x-ray tube comprises a tube housing enclosing said envelope, and (b) said battery being located outside said envelope but within said tube housing.

3. The x-ray tube of claim 1, wherein:

(a) said cathode focusing cup comprises a body defining a first layer cavity having wall and bottom surfaces and a smaller cavity defined in said bottom surface;

(b) said filament comprising a substantially cylindrical coil, and (c) said filament being supported partially recessed within said smaller cavity with its axis substantially parallel to said bottom surface, said coil protruding outside said smaller cavity a distance of about 35% to 50% of its diameter.

4. The x-ray tube of claim 3, wherein:

the width of said larger cavity is in the range of approximately 0.210 to 0.150 inches.

5. The x-ray tube of claim 4, wherein:

(a) said filament coil has a diameter of approximately 0.050 inches;

(b) said filament protrudes outside said smaller cavity by approximately 0.018 inches;

(c) the width of said larger cavity is about 0.210 inches.

6. An x-ray tube including a filament, an anode, a cathode focusing cup proximate the filament, means for applying a DC potential difference between the anode and the cathode focusing cup, means for applying a heating current to the filament and an envelope enclosing the filament, anode and cup, said x-ray tube further comprising:

means for applying a DC bias voltage between the cathode focusing cup and the filament, said biasing voltage being no more than about 30 volts in magnitude.

7. The x-ray tube of claim 6, wherein:

(a) said filament comprises a generally cylindrical coil;

(b) said cathode focusing cup defines a larger cavity having wall and bottom surfaces, and a smaller cavity in said bottom surface, and (c) said coil being suspended with its axis substantially parallel to said bottom surface and aligned with said smaller cavity, said coil being partially recessed within said smaller cavity and protruding from said smaller cavity by a distance in the range of 35% to 50% of the diameter of said coil.

8. The x-ray tube of claim 7, wherein:

said larger cavity has a width in the range of about 0.210 to 0.150 inches.

9. The tube of claim 6, wherein:

said DC bias means comprises a battery.

10. The tube of claim 9, wherein:

said battery is located inside said housing.

11. An x-ray producing system comprising:

(a) a filament;

(b) an anode spaced from the filament and positioned to receive electrons from the filament when the filament is thermionically energized;

(c) a cathode focusing cup located proximate the filament;

(d) means for applying a DC negative electrical potential between the anode and the focusing cup;

(e) means for applying a heating current to the filament to cause thermionic emission of electrons;

(f) a fluid tight housing enclosing said anode, filament and cathode focusing cup, said envelope defining an x-ray transmissive window aligned to transmit to the exterior of the envelope x-rays produced in response to bombardment of the anode by electrons from the filament, and (g) means for applying a voltage DC bias between said filament and said cathode focusing cup.

12. The system of claim 11, wherein:

said bias voltage application means comprises a battery.

13. The system of claim 11, wherein:

said bias voltage is no more than approximately 30 volts in magnitude.

14. The system of claim 12, wherein:

said battery is located within said housing.

15. A source of x-radiation comprising:

(a) a filament coil having a predetermined coil diameter;

(b) a cathode focusing cup supporting said filament coil;

(c) an anode spaced from the cathode cup;

(d) means for applying a DC potential across the anode and cathode focusing cup;

(e) means for applying a heating current through said filament coil;

(f) an envelope enclosing a filament coil, cathode cup and anode;

(g) said cathode cup comprising a body defining a first cavity having wall and bottom surfaces, and a second cavity smaller than the first cavity defined in said bottom surface, the width of said first cavity being in the range of approximately 0.150 to 0.210 inches;

(h) said predetermined filament coil diameter being approximately 0.050 inches;

(i) said filament coil supported in said cathode cup and partially recessed within said second cavity wherein said filament coil protrudes from said second cavity by a distance in the range of approximately 35% to 50% of the diameter of said coil; and (j) battery means for applying a DC bias voltage of approximately 30 volts across said filament coil and said cathode cup.

16. The source of claim 15 further comprising;

(a) a housing enclosing said envelope; and (b) wherein said battery means is mounted inside said housing but outside said envelope.

17. An x-ray tube having a cathode filament, an anode, and a cathode focusing cup, said x-ray tube comprising:

(a) means for applying a DC bias between the cup and the filament, and (b) the cathode cup defining a cathode slot in which the filament is located partially within said slot but at a partially exposed location with respect to the slot.

18. The tube of claim 17, wherein the magnitude of said bias voltage is substantially less than 100 volts.

19. The tube of claim 17, wherein:

(a) said cathode filament defines a coil, and (b) said coil is positioned to protrude from said slot in an amount at least equal to about 35% of the diameter of said coil.

* * * * *